US011087943B2

(12) United States Patent
Douglass et al.

(10) Patent No.: US 11,087,943 B2
(45) Date of Patent: Aug. 10, 2021

(54) FABRICATION OF PRINTED FUSE

(71) Applicant: Eaton Intelligent Power Limited, Dublin (IE)

(72) Inventors: Robert S. Douglass, Wildwood, MO (US); John Trublowski, Troy, MI (US); Rajen Modi, Senoia, GA (US); Nilay Mehta, Peachtree City, GA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/590,020

(22) Filed: Oct. 1, 2019

(65) Prior Publication Data

US 2021/0074501 A1 Mar. 11, 2021

Related U.S. Application Data

(60) Provisional application No. 62/897,024, filed on Sep. 6, 2019.

(51) Int. Cl.

| | |
|---|---|
| ***H01H 69/02*** | (2006.01) |
| ***H01H 85/046*** | (2006.01) |
| ***H01H 85/06*** | (2006.01) |
| ***H01H 85/08*** | (2006.01) |

(52) U.S. Cl.
CPC ..... *H01H 85/046* (2013.01); *H01H 69/022* (2013.01); *H01H 85/06* (2013.01); *H01H 85/08* (2013.01); *Y10T 29/49107* (2015.01)

(58) Field of Classification Search
CPC ..... H02H 3/087; H02H 7/085; H02H 3/08; H01H 9/106; H01H 69/02; H01H 85/38; H01H 85/06; H01H 85/12; Y10T 137/8242; Y10T 29/49107
USPC ..... 29/623, 592.1, 825, 829, 874
See application file for complete search history.

(56) References Cited

U.S. PATENT DOCUMENTS 5,712,610 A * 1/1998 Takeichi ..... H01H 85/046 29/623
7,659,804 B2 * 2/2010 Harris ..... H01H 85/38 337/159

* cited by examiner

*Primary Examiner* — Thiem D Phan
(74) *Attorney, Agent, or Firm* — Armstrong Teasdale LLP

(57) ABSTRACT

A power fuse for protecting an electrical load subject to transient load current cycling events in a direct current electrical power system is provided. The power fuse includes at least one fuse element assembly that includes an elongated planar substrate, a plurality of fusible weak spots, and a conductor. The weak spots are formed on the substrate and are longitudinally spaced from one another on the substrate. The conductor is separately provided from the substrate and the weak spots. The conductor includes a solid elongated strip of metal having no stamped weak spot openings therein and therefore avoiding thermal-mechanical fatigue strain in the conductor when subjected to the transient load current cycling events. The solid elongated strip of metal includes coplanar connector sections that are mounted to respective ones of the weak spots and obliquely extending sections bent out of plane of the connector sections to extend above the substrate.

20 Claims, 8 Drawing Sheets

FABRICATION OF PRINTED FUSE

CROSS REFERENCE TO RELATED APPLICATIONS

This application relates in subject matter to and claims the benefit of U.S. Provisional Application Ser. No. 62/897,024 filed Sep. 6, 2019, entitled "Design and Fabrication of Printed Fuse," the complete disclosure of which is hereby incorporated by reference in its entirety.

BACKGROUND

The field of the disclosure relates generally to electrical circuit protection fuses, and more specifically to the fabrication of power fuses including thermal-mechanical strain fatigue resistant fusible element assemblies.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and open one or more circuits through the fuse to prevent electrical component damage.

Full-range power fuses are operable in high voltage power distributions to safely interrupt both relatively high fault currents and relatively low fault currents with equal effectiveness. In view of constantly expanding variations of electrical power systems, known fuses of this type are disadvantaged in some aspects. Improvements in full-range power fuses are desired to meet the needs of the marketplace.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION

Figure 1:
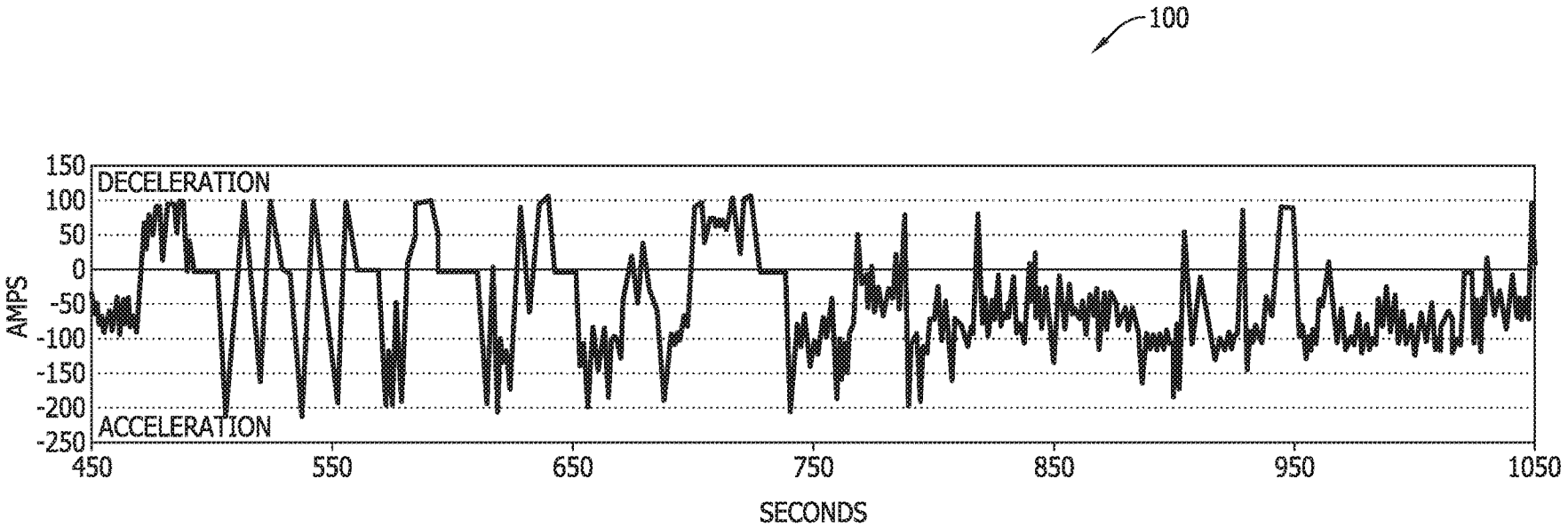
FIG. 1 illustrates an exemplary transient current pulse profile generated in an electrical power system.

Recent advancements in electric vehicle technologies present unique challenges to fuse manufacturers. Electric vehicle manufacturers are seeking fusible circuit protection for electrical power distribution systems operating at voltages much higher than conventional electrical power distribution systems for vehicles, while simultaneously seeking smaller fuses to meet electric vehicle specifications and demands.

Electrical power systems for conventional, internal combustion engine-powered vehicles operate at relatively low voltages, typically at or below about 48 VDC. Electrical power systems for electric-powered vehicles, referred to herein as electric vehicles (EVs), however, operate at much higher voltages. The relatively high voltage systems (e.g., 200 VDC and above) of EVs generally enables the batteries to store more energy from a power source and provide more energy to an electric motor of the vehicle with lower losses (e.g., heat loss) than conventional batteries storing energy at 12 Volts (V) or 24 V used with internal combustion engines, and more recent 48 V power systems.

EV original equipment manufacturers (OEMs) employ circuit protection fuses to protect electrical loads in all-battery electric vehicles (BEVs), hybrid electric vehicles (HEVs) and plug-in hybrid electric vehicles (PHEVs). Across each EV type, EV manufacturers seek to maximize the mileage range of the EV per battery charge while reducing cost of ownership. Accomplishing these objectives turns on the energy storage and power delivery of the EV system, as well as the size, volume, and mass of the vehicle components that are carried by the power system. Smaller and/or lighter vehicles will more effectively meet these demands than larger and heavier vehicles. As such, all EV components are now being scrutinized for potential size, weight, and cost savings.

Generally speaking, larger components tend to have higher associated material costs, tend to increase the overall size of the EV or occupy an undue amount of space in a shrinking vehicle volume, and tend to introduce greater mass that directly reduces the vehicle mileage per single battery charge. Known high voltage circuit protection fuses are, however, relatively large and relatively heavy components. Historically, and for good reason, circuit protection fuses have tended to increase in size to meet the demands of high voltage power systems as opposed to lower voltage systems. As such, existing fuses needed to protect high voltage EV power systems are much larger than the existing fuses needed to protect the lower voltage power systems of conventional, internal combustion engine-powered vehicles. Smaller and lighter high voltage power fuses are desired to meet the needs of EV manufacturers, without sacrificing circuit protection performance.

Electrical power systems for state of the art EVs may operate at voltages as high as 450 VDC or even higher. The increased power system voltage desirably delivers more power to the EV per battery charge. Operating conditions of electrical fuses in such high voltage power systems is much more severe, however, than lower voltage systems. Specifically, specifications relating to electrical arcing conditions when the fuse opens can be particularly difficult to meet for higher voltage power systems, especially when coupled with the industry preference for reduction in the size of electrical fuses. Current cycling loads imposed on power fuses by state of the art EVs also tend to impose mechanical strain and wear that can lead to premature failure of a conventional fuse element. While known power fuses are presently available for use by EV OEMs in high voltage circuitry of state of the art EV applications, the size and weight, not to mention the cost, of conventional power fuses capable of meeting the requirements of high voltage power systems for EVs is impractically high for implementation in new EVs.

Providing relatively smaller power fuses that can capably handle high current and high battery voltages of state of the art EV power systems, while still providing acceptable interruption performance as the fuse element operates at high voltages is challenging, to say the least. Improvements are needed to longstanding and unfulfilled needs in the art.

While described in the context of EV applications and a particular type and ratings of fuse, the benefits of the disclosure are not necessarily limited to EV applications or to the particular type or ratings described. Rather the benefits of the disclosure are believed to more broadly accrue to many different power system applications and can also be practiced in part or in whole to construct different types of fuses having similar or different ratings than those discussed herein.

FIG. 1 illustrates an exemplary current drive profile 100 in an EV power system application that can render a fuse, and specifically the fuse element or elements therein susceptible to load current cycling fatigue. The current is shown along a vertical axis in FIG. 1 with time shown along the horizontal axis. In typical EV power system applications, power fuses are used as circuit protection devices to prevent damage to electrical loads from electrical fault conditions. The power system may be operated at voltages above 500 V and/or at currents above 150 Amperes (A). Considering the example of FIG. 1, EV power systems experience large seemingly random variance in current loads over relatively short periods of time, for example, between −250 A and 150 A. The seemingly random variance in current produces current pulses of various magnitudes in sequences caused by seemingly random driving habits based on the actions of the driver of the EV vehicle, traffic conditions and/or road conditions. This creates a practically infinite variety of current loading cycles on the EV drive motor, the primary drive battery, and any protective power fuse included in the system.

Such random current loading conditions, exemplified in the current pulse profile of FIG. 1, are cyclic in nature for both the acceleration of the EV (corresponding to battery drain) and the deceleration of the EV (corresponding to regenerative battery charging). This current cyclic loading imposes thermal cycling stress on the fuse element, and more specifically in the weak spots of the fuse element assembly in the power fuse, by way of a joule effect heating process. This thermal cyclic loading of the fuse element imposes mechanical expansion and contraction cycles on the fuse element weak spots in particular. This repeated mechanical cyclic loading of the fuse element weak spots imposes an accumulating strain that damages the weak spots to the point of breakage over time. For the purposes of the present description, this thermal-mechanical process and phenomena is referred to herein as fuse fatigue. As explained further below, fuse fatigue is attributable mainly to creep strain as the fuse endures the drive profile. Heat generated in the fuse element weak spots is the primary mechanism leading to the onset of fuse fatigue.

Figure 2A:
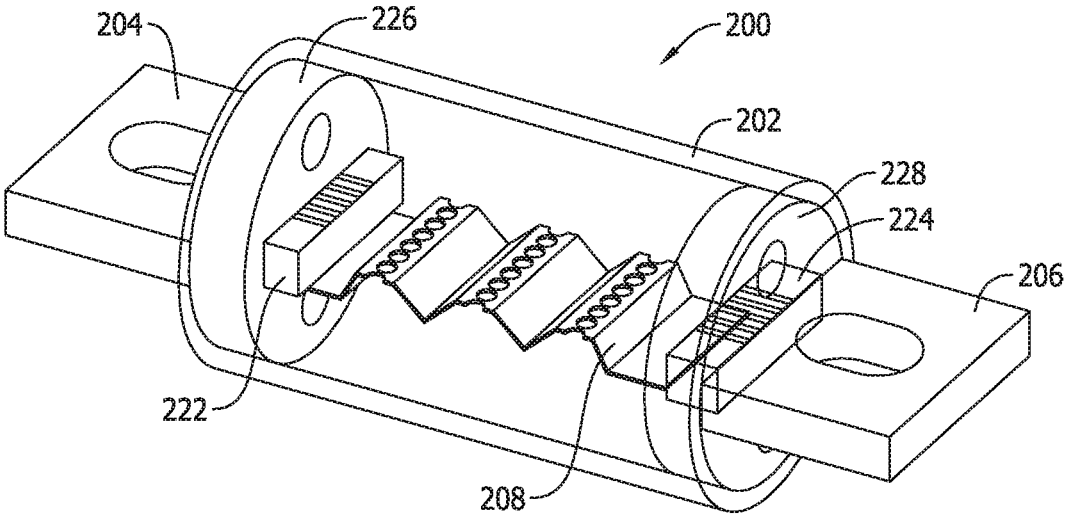
FIG. 2A (PRIOR ART)
FIG. 2A is a perspective view of a known power fuse.

FIG. 2A shows a known high voltage power fuse 200 that is designed for use with an EV power system. The power fuse 200 includes a housing 202, terminal blades 204, 206 configured to connect to line and load side circuitries, and a fuse element assembly 208 that completes an electrical connection between the terminal blades 204, 206 through terminal contact blocks 222, 224 provided on end plates 226, 228. When subjected to predetermined current conditions, at least a portion of the fuse element assembly 208 melts, disintegrates, or otherwise structurally fails and opens the circuit path between the terminal blades 204, 206. Load side circuitry is therefore electrically isolated from the line side circuitry to protect load side circuit components from damage when electrical fault conditions occur.

Figure 2B:
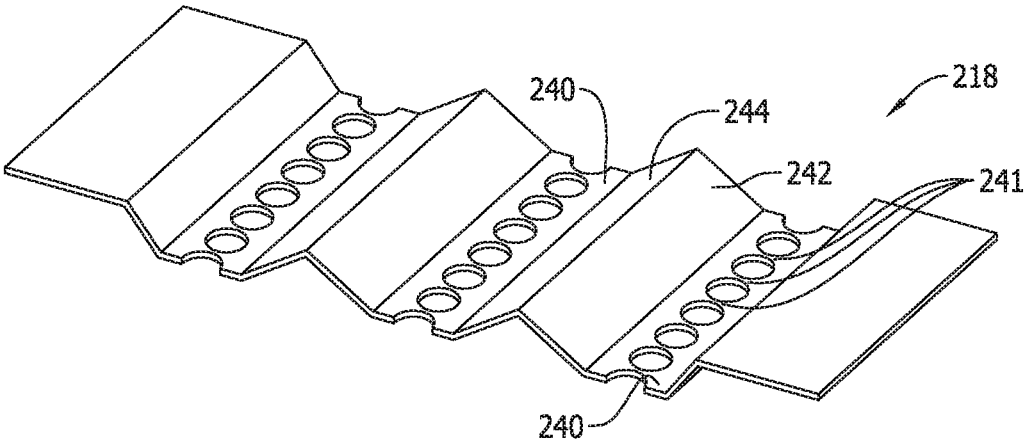
FIG. 2B (PRIOR ART)
FIG. 2B is a perspective view of the fuse element assembly of the power fuse shown in FIG. 2A.

FIG. 2B illustrates the fuse element assembly 208 in further detail. The fuse element assembly 218 is generally formed from a strip of electrically conductive material into a series of co-planar sections 240 connected by oblique sections 242, 244. The oblique sections 242, 244 are formed or bent out of plane from the planar sections 240.

In the example shown, the planar sections 240 define a plurality of sections of reduced cross-sectional area 241, referred to in the art as weak spots. The weak spots 241 are defined by apertures in the planar sections 240. The weak spots 241 correspond to the narrow portion of the section 240 between adjacent apertures. The reduced cross-sectional areas at the weak spots 241 will experience higher heat concentration than the rest of the fuse element assembly 218 as current flows through the fuse element assembly 218.

The weak spots 241 of the fuse element assembly 218 fabricated by metal stamping or punching have been found to be disadvantageous for EV applications having the type of cyclic current loads described above. Such stamped fuse element designs undesirably introduce mechanical strains and stresses on the fuse element weak spots 241 such that a shorter service life tends to result. This short fuse service life manifests itself in the form of nuisance fuse operation resulting from the mechanical fatigue of the fuse element at the weak spots 241.

Figure 2C:
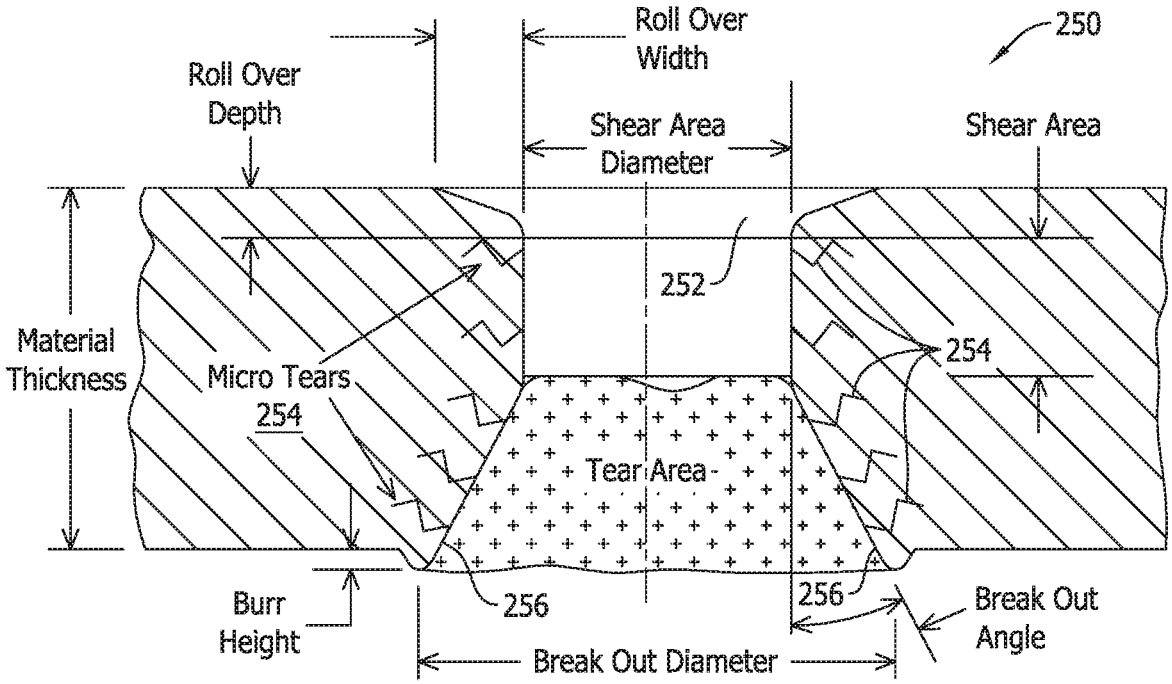
FIG. 2C (PRIOR ART)
FIG. 2C is a schematic diagram of a weak spot of the fuse element assembly shown in FIG. 2B.

FIG. 2C shows the cross-sectional view of a metal plate 250 after an aperture 252 is punched through the metal plate 250. After a punching or stamping process, micro tears 254 occur along the border 256 of the aperture 252.

Figure 2D:
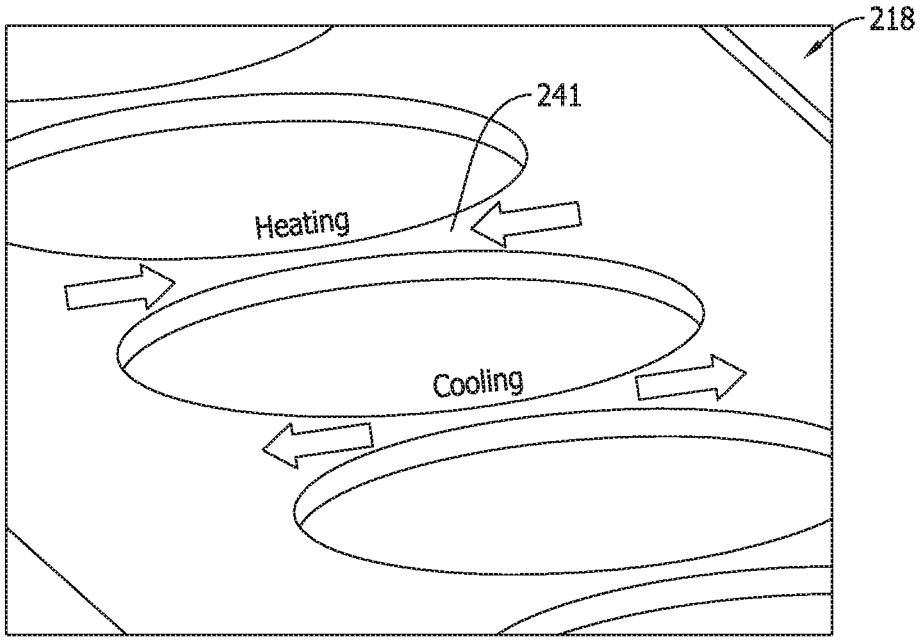
FIG. 2D (PRIOR ART)
FIG. 2D is a schematic diagram illustrating the weak spots of the fuse element assembly shown in FIG. 2B under load current cycling events.
Figure 2E:
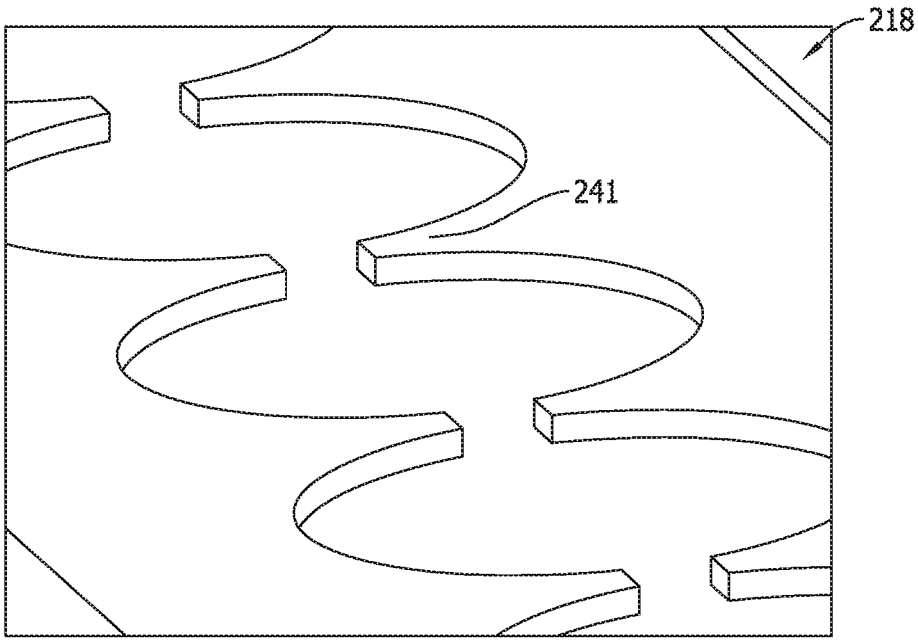
FIG. 2E (PRIOR ART)
FIG. 2E is a schematic diagram illustrating the weak-spots of the fuse element assembly shown in FIG. 2E fail after load current cycling events.

As shown in FIGS. 2D and 2E, the weak spots 241 of the fuse element assembly 218 experience repeated high current pulses and cyclic current events (FIG. 2D), which lead to metal fatigue from grain boundary disruptions followed by crack propagation and failure in the fuse element assembly 218 at the weak spots 241 (FIG. 2E). The mechanical constraints of the fuse element assembly 218 are inherent in the stamped fuse element design and manufacture, which unfortunately has been found to promote in-plane buckling of the weak spots 241 during repeated load current cycling. This in-plane buckling is the result of damage to the metal grain boundaries where a separation or slippage occurs between adjacent metal grains. Such buckling of weak spots 241 occurs over time and is accelerated and more pronounced with higher transient current pulses. The greater the heating-cooling delta in the transient current pulses the greater the mechanical influence, and thus the greater the in-place buckling deformation of the weak spots 241.

Repeated physical mechanical manipulations of metal, caused by the heating effects of the transient current pulses, in turn cause changes in the grain structure of metal fuse element. These mechanical manipulations are sometimes referred to as working the metal. Working of metals will cause a strengthening of the grain boundaries where adjacent grains are tightly constrained to neighboring grains. Over working of a metal will result in disruptions in the grain boundary, where grains slip past each other and cause what is called a slip band or plane. This slippage and separation between the grains result in a localized increase of the electrical resistance that accelerates the fatigue process by increasing the heating effect of the current pulses. The formation of slip bands is where fatigue cracks are first initiated.

The inventors have found that a manufacturing method of stamping or punching metal to form the fuse element assembly 218 causes localized slip bands on all stamped edges of the fuse element weak spots 241 because the stamping processes to form the weak spots 241 are shearing and tearing mechanical processes. This tearing process pre-stresses the weak spots 241 with many slip band regions. The slip bands and fatigue cracks, combined with the buckling described due to heat effects, eventually lead to a premature structural failure of the weak spots 241 that are unrelated to electrical fault conditions. Such premature failure mode that does not relate to a problematic electrical condition in the power system is sometimes referred to as nuisance operation of the fuse. Since once the fuse elements fail the circuitry connected to the fuse is not operational again until the fuse is replaced, avoiding such nuisance operation is highly desirable in an EV power system from the perspective of both EV manufacturers and consumers. Indeed, given an increased interest in EV vehicles and their power systems, the effects of fuse fatigue are deemed to be a negative Critical to Quality (CTQ) attribute in the vehicle design.

Accordingly, improved fuse elements and methods for fabricating fuse elements including weak spots that are fatigue resistant are highly desirable.

Exemplary embodiments of fuse elements and the method of fabricating such fuse elements are described below that advantageously avoid the strain damages at weak spots from the manufacturing process of stamping or punching, while also providing an effective arc extinguishing mechanism. Weak spots in the exemplary embodiments are formed directly onto a planar substrate, avoiding micro tears from the punching or stamping processes. The weak spots are connected by a separately-fabricated conductor having coplanar connector sections and oblique connector sections used for effective arc extinguishing.

While described below in reference to particular embodiments, such description is intended for the sake of illustration rather than limitation. The significant benefit of the inventive concepts will now be explained in reference to the exemplary embodiments illustrated in the Figures. Method aspects will be in part apparent and in part explicit in the following discussion.

Figure 3:
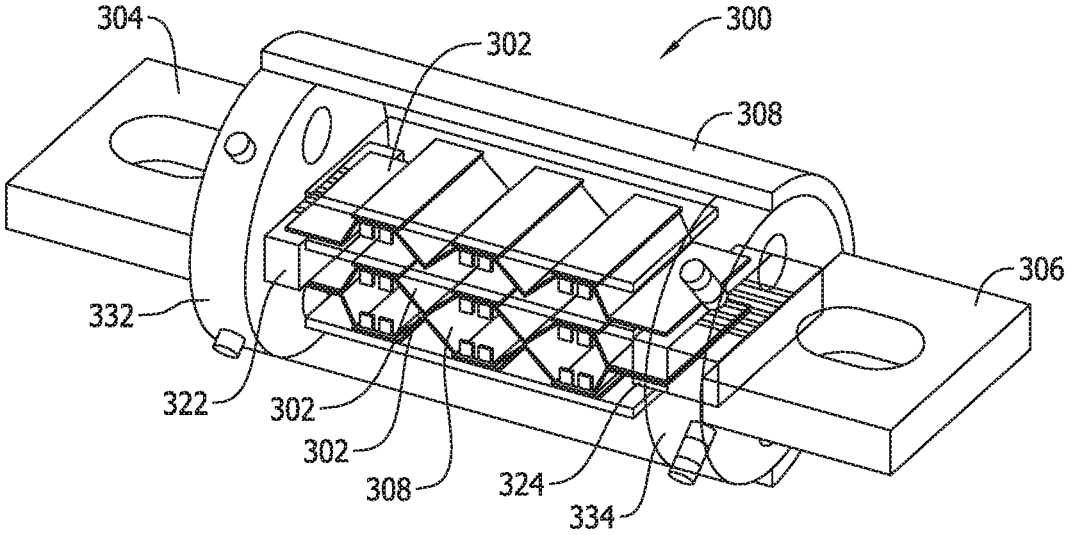
FIG. 3 is a partial perspective view of an exemplary power fuse.

Referring now to FIGS. 3-7, an exemplary power fuse 300 is illustrated. The power fuse 300 includes at least one fuse element assembly 302 (FIG. 3). The power fuse 300 may include a housing 308. The power fuse 300 further includes terminal blades 304, 306 configured to connect the power fuse 300 to line and load side circuitry. The electrical connection of the fuse element assembly 302 is completed through terminal contact blocks 322, 324 provided on end plates 332, 334 and the terminal blades 304, 306. When subjected to predetermined current conditions, at least a portion of the fuse element assembly 302 melts, disintegrates, or otherwise structurally fails and opens the circuit path between the terminal blades 304, 306. Load side circuitry is therefore electrically isolated from the line side circuitry to protect load side circuit components from damage when electrical fault conditions occur.

Figure 4:
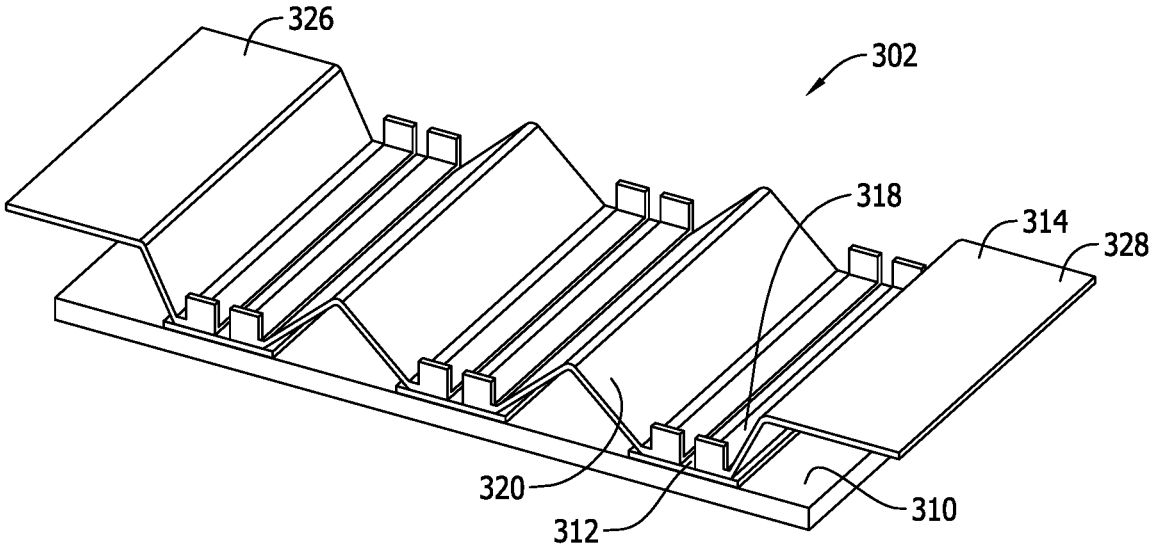
FIG. 4 is an enlarged view of the fuse element assembly for the power fuse shown in FIG. 3.

FIG. 4 shows the exemplary fuse element assembly 302 in further detail. The fuse element assembly 302 includes a substrate 310, a plurality of weak spots 312, and a conductor 314.

Figure 5:
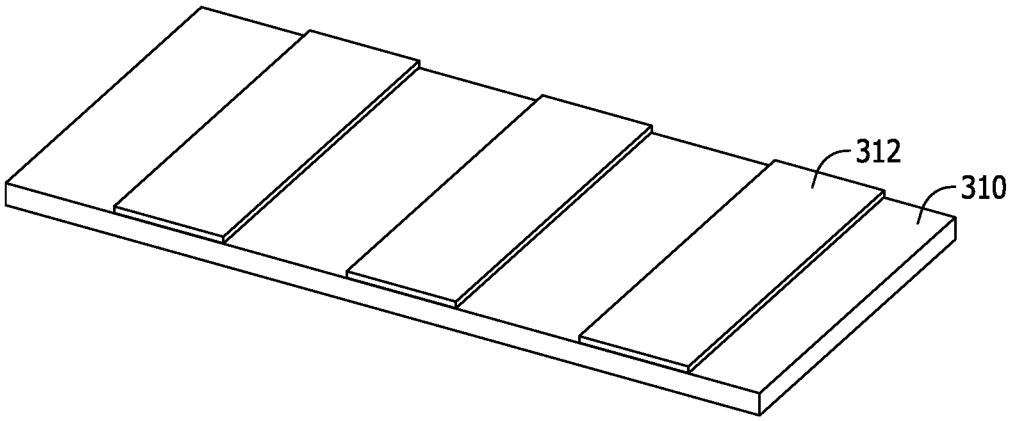
FIG. 5 shows the substrate and weak spots of the fuse element assembly shown in FIG. 4.

The substrate 310 may be a planar substrate (FIG. 5). The substrate 310 may be elongated. In the exemplary embodiment, the top surface of the substrate 310 is rectangular. In some embodiments, the substrate 310 is ceramic. In one example, the substrate is alumina ceramic. An alumina substrate has a relatively high thermal conductivity (e.g., approximately 30 $Wm^{-1}K^{-1}$), which helps dissipate heat from the weak spots 312.

In the exemplary embodiment, the weak spots 312 are formed on the substrate 310. The number of weak spots 312 can be three or other numbers such as one, two, or four that enable the fuse element assembly 302 to function as described herein. The weak spots 312 are spaced apart from each other. In some embodiments, the weak spots 312 are disposed apart from each other along the longitudinal direction of the substrate 310. The weak spots 312 are made of conductive material such as copper. The weak spots 312 may be printed on the substrate 310 using known techniques. In some embodiments, however, the weak spots 312 may be formed on the substrate 310 using techniques other than printing. Multiple layers of the weak spots 312 may be formed over one another to change the overall thickness of the weak spots 312. The electrical resistance and performance of the weak spots 312 are, therefore, relatively more controllable than the weak spots formed by metal stamping or punching. Because the weak spots 312 are formed without mechanical micro tears from the mechanical manufacturing processes like metal stamping or punching, the weak spots 312 do not suffer from load current cycling fatigue as the weak spots 241 of the known fuse 200, especially when under the large, seemingly random cyclic current changes in a direct current power system of an EV.

Figure 6:
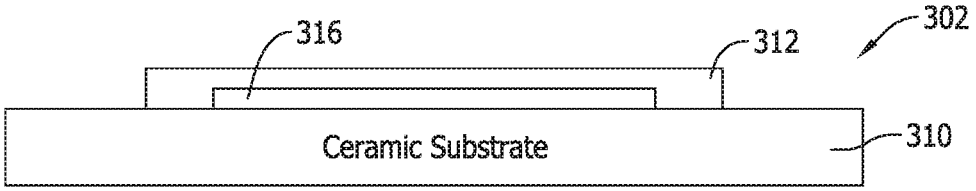
FIG. 6 is a cross-sectional magnified view of a portion of an exemplary fuse element assembly.

In some embodiments, the fuse element assembly 302 further includes a dielectric layer 316 disposed between the substrate 310 and the weak spots 312 (FIG. 6). In an exemplary embodiment, the dielectric layer 316 may be glass or another suitable dielectric material known in the art. When weak spots 312 are formed with only electrically-conductive materials, the electrically-conductive materials separate when the materials melt in a fusing condition but may reconnect thus allowing the circuit to reconnect. To minimize this reconnection of weak spots 312 to allow the power fuse 300 to function at predetermined current conditions, a layer of dielectric, glass-based layer 316 is deposited under the weak spot 312. The material for the dielectric layer 316 is selected such that it melts at a higher temperature than the weak spots 312 but at a low enough temperature that allows diffusion. The melting temperature of the dielectric layer 316 is approximately 25° C.-50° C. above the maximum fusing temperature of the weak spots 312. This temperature range allows the dielectric layer 316 to be mechanically stable during the fusing process to support the weak spots 312 while allowing the dielectric material to diffuse into the weak spots 312. The melting temperature of the dielectric layer 316 may vary depending on materials. The diffusion is desired for two reasons. First, it provides a means to adjust the weak spot resistance, where more fusing results in more diffusion and higher resistivity. Second, the diffused dielectric layer 316 changes the wetting characteristics of the conductor and does not allow the melted weak spots 312 to reattach.

Referring back to FIG. 4, the weak spots 312 of the fuse element assembly are connected through the conductor 314. In the exemplary embodiments, the conductor 314 is made from a solid elongated strip metal. The conductor 314 may be made by punching or stamping a solid elongated strip metal. The thickness of the conductor 314 is greater than the weak spots 312. As a result, the weak spots 312 experience more heat than the conductor 314 and open before the conductor 314 under predetermined current conditions. The conductor 314, therefore, does not have stamped weak spot openings and avoids thermal-mechanical fatigue strain when subjected to transient load current cycling events.

In an exemplary embodiment, the conductor 314 includes coplanar connector sections 318 and obliquely extending sections 320. The obliquely extending sections 320 bend out of plane of the connector sections 318. The conductor 314 may further include first and second terminal tabs extending from the obliquely extending sections 320. The conductor 314 couples to terminal contact blocks 322, 324 through the terminal tabs 326, 328.

In the contemplated embodiment, the coplanar connector sections 318 are mounted on respective ones of the weak spots 312. Alternatively, the coplanar connector sections 318 are mounted on the substrate 310 and are connected with weak spots 312. As a result, the obliquely extending sections 320 extend above the substrate 310 in between the weak spots 312, and the first and second terminal tabs 326, 328 may extend coplanar to one another in a plane spaced from the connector sections 318 and the substrate 310. The plane of the first and second terminal tabs 326, 328 may extend parallel to the connector sections 318 and the substrate 310.

In the exemplary embodiment, the power fuse 300 includes three fuse element assemblies 302 (FIG. 3). The power fuse 300 may in other embodiments include other numbers of fuse element assemblies 302, such as one and two, that enable the power fuse 300 to function as described herein. The plurality of fuse element assemblies 302 are connected in parallel with each other to increase the ratings of the power fuse 300 without increasing the physical size of the power fuse 300. The fuse element assemblies 302 may be arranged such that two neighboring fuse element assemblies are mirror images of each other. The fuse element assemblies 302 may be stacked together with the substrate of one fuse element assembly facing the conductor of another fuse element assembly.

A full-range fuse can be realized by using at least one fuse element assembly 302 that is responsive to relatively low current operation (or overload faults) and at least one fuse element assembly 302 that is responsive to relatively high current operation (or short circuit faults). The fuse element assemblies 302 may also be used in a fuse that is not full range.

Figure 7:
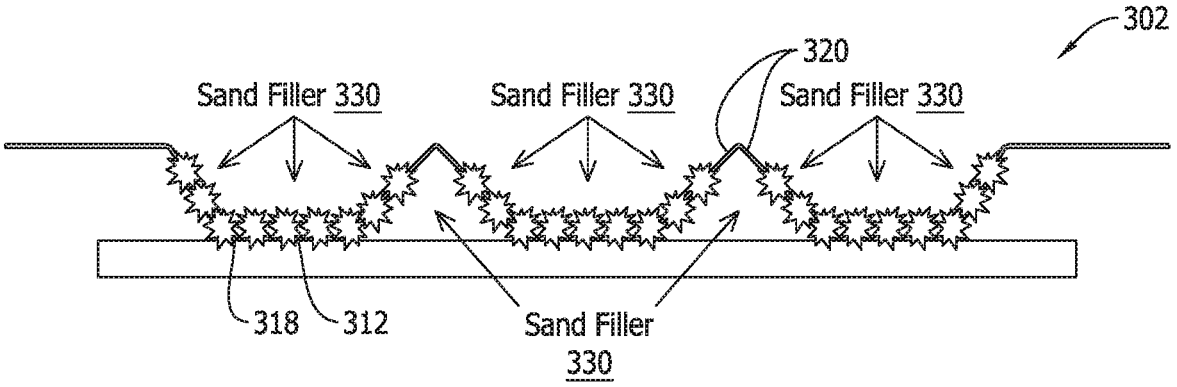
FIG. 7 is a schematic diagram illustrating the arcing in the fuse element assembly shown in FIG. 4.

In the exemplary embodiment, the power fuse 300 may further include an arc extinguishing filler 330 (FIG. 7). The arc extinguishing filler 330 surrounds at least part of the fuse element assembly 302. The arc extinguishing filler 330 may be disposed underneath the obliquely extending sections 320. The arc extinguishing filler 330 may also be disposed above the obliquely extending sections 320, the coplanar connector sections 318, and the weak spots 312. The arc extinguishing filler 330 may be introduced to the housing 308 via one or more fill openings in one of the end plates 332, 334 that are sealed with plugs (not shown). The plugs may be fabricated from steel, plastic or other materials in various embodiments. In other embodiments a fill hole or fill holes may be provided in other locations, including but not limited to the housing 308 to facilitate the introduction of the arc extinguishing filler 330.

In one contemplated embodiment, the arc extinguishing filler 330 is composed of quartz silica sand and a sodium silicate binder. The quartz sand has a relatively high heat conduction and absorption capacity in its loose compacted state, but can be silicated to provide improved performance. For example, a liquid sodium silicate solution is added to the sand and then the free water is dried off. Separately provided arc barrier materials (not shown) may also be provided to prevent arcing from reaching the ends of the terminal tabs 326, 328.

In the exemplary embodiment, the fuse element assembly 302 provides access of the arc to the arc quenching medium such as sand in the arc extinguishing filler 330. When weak spots 312 melt at predetermined current conditions, arcing starts at weak spots 312. As the arc grows in length it migrates from the weak spots 312 and the substrate 310 and follows the obliquely extending sections 320 into the surrounding arc extinguishing filler 330 for efficient cooling and quicker extinguishment.

Figure 8:
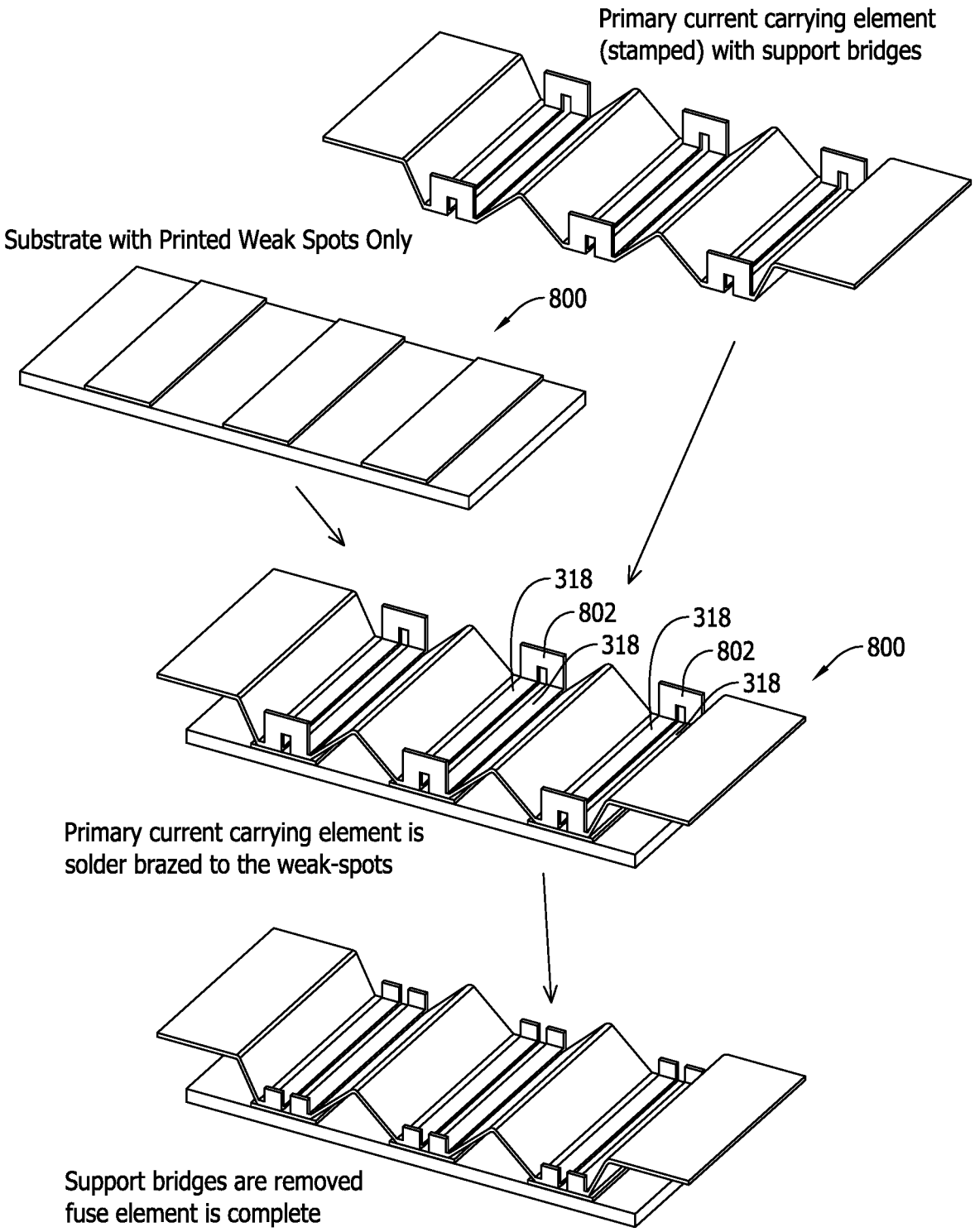
FIG. 8 is a schematic diagram of an exemplary method for fabricating the power fuse shown in FIGS. 3-7.
Figure 9:
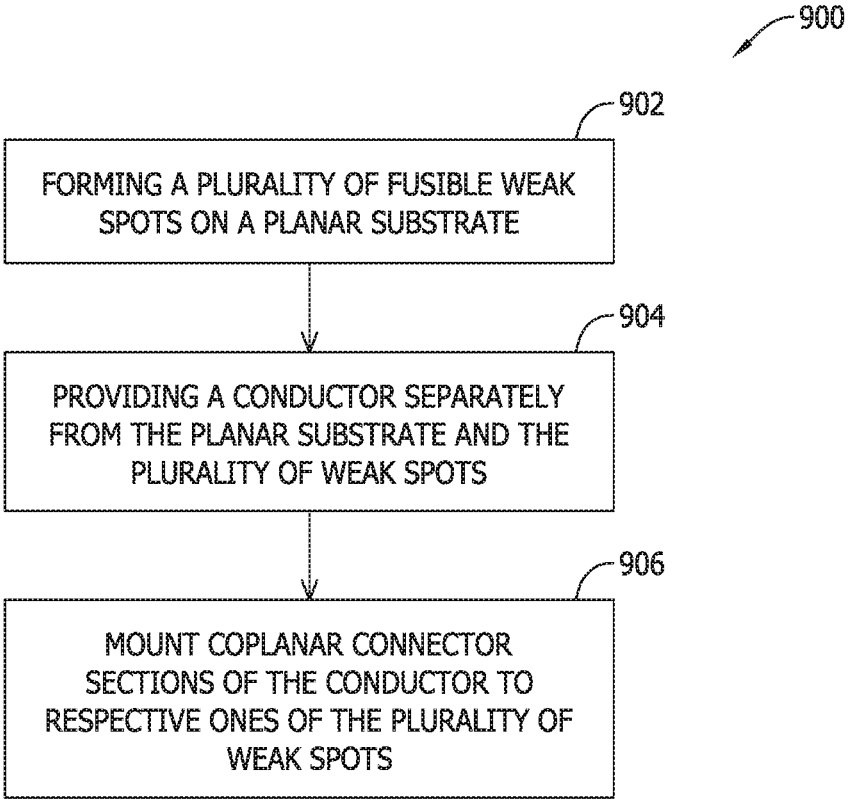
FIG. 9 is a flow chart illustrating the method shown in FIG. 8.

FIGS. 8 and 9 show an exemplary method 900 of fabricating a power fuse for protecting an electrical load subject to transient load current cycling events in a direct current electrical power system. FIG. 8 shows a schematic diagram of the method 900, while FIG. 9 shows a flow chart of the method 900. The method 900 includes forming 902 a plurality of fusible weak spots on a planar substrate such that the plurality of fusible weak spots are longitudinally spaced from one another on the planar substrate. The method 900 further includes providing 904 a conductor separately from the planar substrate and the plurality of weak spots. The number of coplanar connector sections of the conductor may be the same as the number of weak spots formed on the planar substrate. The method 900 also includes 906 mounting the coplanar connector sections of the conductor to respective ones of the plurality of weak spots. As a result, the obliquely extending sections of the conductor extend above the elongated planar substrate in between the plurality of fusible weak spots, and the first and second terminal tabs of the conductor extend coplanar to one another in a plane parallel to but spaced from the coplanar connector sections and the substrate. In one example, the coplanar connection sections of the conductor are brazed to the weak spots. In some embodiments, the conductor is formed in one piece. The conductor 800 may include support bridges 802 connecting the coplanar connector sections 318 (FIG. 8). The method 900 may further include removing the support bridges after the coplanar connector sections of the conductor have been mounted on respective ones of the plurality of weak spots.

The benefits and advantages of the present disclosure are now believed to have been amply illustrated in relation to the exemplary embodiments disclosed.

Various embodiments of power fuses and fuse element assemblies and their fabrication methods are described herein including a plurality of weak spots formed on a substrate without stamped weak spot openings, thereby avoiding thermal-mechanical fatigue strain in the fuse element assembly when subjected to transient load current cycling events. Further, the fuse assembly includes a conductor having coplanar connector sections mounted on the weak spots and obliquely extending sections extending above the substrate such that an arc extinguishing filler can be disposed to surround at least part of the fuse element assembly, thereby effectively extinguishing arc generated after the fuse element assembly opens at predetermined current conditions.

While exemplary embodiments of components, assemblies and systems are described, variations of the components, assemblies and systems are possible to achieve similar advantages and effects. Specifically, the shape and the geometry of the components and assemblies, and the relative locations of the components in the assembly, may be varied from those described and depicted without departing from inventive concepts described. Also, in certain embodiments, certain components in the assemblies described may be omitted to accommodate particular types of fuses or the needs of particular installations, while still providing the needed performance and functionality of the fuses.

An embodiment of a power fuse for protecting an electrical load subject to transient load current cycling events in a direct current electrical power system has been disclosed. The power fuse includes at least one fuse element assembly that includes an elongated planar substrate, a plurality of fusible weak spots, and a conductor. The plurality of fusible weak spots are formed on the planar substrate and are longitudinally spaced from one another on the planar substrate. The conductor is separately provided from the planar substrate and the plurality of weak spots. The conductor includes a solid elongated strip of metal having no stamped weak spot openings therein and therefore avoiding thermal-mechanical fatigue strain in the conductor when subjected to the transient load current cycling events. The solid elongated strip of metal includes coplanar connector sections that are mounted to respective ones of the plurality of weak spots on the planar substrate and obliquely extending sections bent out of plane of the connector sections to extend above the elongated planar substrate in between the plurality of fusible weak spots. The conductor further includes first and second terminal tabs that extend coplanar to one another in a plane parallel to but spaced from the connector sections and the substrate.

Optionally, the power fuse further includes an arc quenching media that surrounds at least part of the at least one fuse element assembly. The at least one fuse element assembly further includes a dielectric layer formed over the substrate and nested between the substrate and the plurality of weak spots. The conductor is formed in one piece. The substrate is alumina ceramic. The power fuse further includes a housing enclosing the at least one fuse element assembly. The plurality of fusible weak spots are printed on the planar substrate. The power fuse of has a voltage rating of at least 500 V. The power fuse has a current rating of at least 150 A. The at least one fuse element assembly includes first and second fuse element assemblies electrically connected in parallel with each other.

A method of fabricating a power fuse for protecting an electrical load subject to transient load current cycling events in a direct current electrical power system has been disclosed. The method includes forming a plurality of fusible weak spots on an elongated planar substrate such that the plurality of fusible weak spots are longitudinally spaced from one another on the planar substrate. The method further includes providing a conductor separately from the planar substrate and the plurality of weak spots. The conductor includes a solid elongated strip of metal having no stamped weak spot openings therein and therefore avoiding thermal-mechanical fatigue strain in the conductor when subjected to the transient load current cycling events. The solid elongated strip of metal includes coplanar connector sections and obliquely extending sections bent out of plane of the connector sections. The conductor further includes first and second terminal tabs that extend coplanar to one another. The method also includes mounting the coplanar connector sections of the conductor to respective ones of the plurality of weak spots on the planar substrate such that the obliquely extending sections of the conductor extend above the elongated planar substrate in between the plurality of fusible weak spots and the first and second terminal tabs extend coplanar to one another in a plane parallel to but spaced from the connector sections and the substrate, thereby completing a first fuse element assembly.

Optionally, the method further includes surrounding at least part of the first fuse element assembly with an arc quenching medium. Forming a plurality of weak spots includes printing the plurality of weak spots on the elongated planar substrate. Forming a plurality of weak spots further includes providing a dielectric layer on the substrate, and forming the plurality of weak spots over the dielectric layer to cover the dielectric layer and to nest the dielectric layer between the substrate and the plurality of weak spots. Forming a dielectric layer includes printing the dielectric layer on the substrate, and forming the plurality of weak spots includes printing the plurality of weak spots over the dielectric layer to cover the dielectric layer and to nest the dielectric layer between the substrate and the plurality of weak spots. Providing a conductor further includes forming the conductor in one piece. The conductor is formed with support bridges connecting the coplanar connector sections, and mounting the coplanar connector sections further includes removing the support bridges after the coplanar connector sections of the conductor have been mounted on respective ones of the plurality of weak spots. The substrate includes alumina ceramic. The method further includes forming a second fuse element assembly, and electrically connecting the first and second fuse element assemblies in parallel with each other. The method further includes electrically connecting the first and second terminal tabs of the conductor with first and second conductive terminals, and enclosing the first fuse element assembly with a housing, leaving at least part of the first and second conductive terminals exposed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A power fuse for protecting an electrical load subject to transient load current cycling events in a direct current electrical power system, the power fuse comprising:

at least one fuse element assembly comprising:

an elongated planar substrate;

a plurality of fusible weak spots formed on the planar substrate and being longitudinally spaced from one another on the planar substrate; and a conductor separately provided from the planar substrate and the plurality of weak spots;

wherein the conductor comprises a solid elongated strip of metal having no stamped weak spot openings therein and therefore avoiding thermal-mechanical fatigue strain in the conductor when subjected to the transient load current cycling events;

wherein the solid elongated strip of metal includes coplanar connector sections that are mounted to respective ones of the plurality of weak spots on the planar substrate and obliquely extending sections bent out of plane of the connector sections to extend above the elongated planar substrate in between the plurality of fusible weak spots;

wherein the conductor further comprises first and second terminal tabs that extend coplanar to one another in a plane parallel to but spaced from the connector sections and the substrate.

2. The power fuse of claim 1, further comprising an arc quenching media that surrounds at least part of the at least one fuse element assembly.

3. The power fuse of claim 1, wherein the at least one fuse element assembly further comprises a dielectric layer formed over the substrate and nested between the substrate and the plurality of weak spots.

4. The power fuse of claim 1, wherein the conductor is formed in one piece.

5. The power fuse of claim 1, wherein the substrate is alumina ceramic.

6. The power fuse of claim 1, further comprising a housing enclosing the at least one fuse element assembly.

7. The power fuse of claim 1, wherein the plurality of fusible weak spots are printed on the planar substrate.

8. The power fuse of claim 1, wherein the power fuse has a voltage rating of at least 500 V.

9. The power fuse of claim 1, wherein the power fuse has a current rating of at least 150 A.

10. The power fuse of claim 1, wherein the at least one fuse element assembly comprises first and second fuse element assemblies electrically connected in parallel with each other.

11. A method of fabricating a power fuse for protecting an electrical load subject to transient load current cycling events in a direct current electrical power system, the method comprising:

forming a plurality of fusible weak spots on an elongated planar substrate such that the plurality of fusible weak spots are longitudinally spaced from one another on the planar substrate;

providing a conductor separately from the planar substrate and the plurality of weak spots, wherein the conductor comprises a solid elongated strip of metal having no stamped weak spot openings therein and therefore avoiding thermal-mechanical fatigue strain in the conductor when subjected to the transient load current cycling events;

wherein the solid elongated strip of metal includes coplanar connector sections and obliquely extending sections bent out of plane of the connector sections; and wherein the conductor further comprises first and second terminal tabs that extend coplanar to one another; and mounting the coplanar connector sections of the conductor to respective ones of the plurality of weak spots on the planar substrate such that the obliquely extending sections of the conductor extend above the elongated planar substrate in between the plurality of fusible weak spots and the first and second terminal tabs extend coplanar to one another in a plane parallel to but spaced from the coplanar connector sections and the substrate, thereby completing a first fuse element assembly.

12. The method of claim 11, further comprising surrounding at least part of the first fuse element assembly with an arc quenching medium.

13. The method of claim 11, wherein forming a plurality of weak spots comprises printing the plurality of weak spots on the elongated planar substrate.

14. The method of claim 11, wherein forming a plurality of weak spots further comprises:

providing a dielectric layer on the substrate; and forming the plurality of weak spots over the dielectric layer to cover the dielectric layer and to nest the dielectric layer between the substrate and the plurality of weak spots.

15. The method of claim 14, wherein forming a dielectric layer comprises printing the dielectric layer on the substrate, and forming the plurality of weak spots comprises printing the plurality of weak spots over the dielectric layer to cover the dielectric layer and to nest the dielectric layer between the substrate and the plurality of weak spots.

16. The method of claim 11, wherein providing a conductor further comprises forming the conductor in one piece.

17. The method of claim 16, wherein the conductor is formed with support bridges connecting the coplanar connector sections, and mounting the coplanar connector sections further comprises removing the support bridges after the coplanar connector sections of the conductor have been mounted on respective ones of the plurality of weak spots.

18. The method of claim 11, wherein the substrate comprises alumina ceramic.

19. The method of claim 11, further comprising:

forming a second fuse element assembly; and electrically connecting the first and second fuse element assemblies in parallel with each other.

20. The method of claim 11, further comprising:

electrically connecting the first and second terminal tabs of the conductor with first and second conductive terminals; and enclosing the first fuse element assembly with a housing, leaving at least part of the first and second conductive terminals exposed.

* * * * *